US011156241B2

(12) United States Patent
Eilers et al.

(10) Patent No.: US 11,156,241 B2
(45) Date of Patent: Oct. 26, 2021

(54) DIFFUSER

(71) Applicant: FISHER CONTROLS INTERNATIONAL LLC, Marshalltown, IA (US)

(72) Inventors: Daniel J. Eilers, Marshalltown, IA (US); Kyle Thomas McNulty, Marshalltown, IA (US)

(73) Assignee: FISHER CONTROLS INTERNATIONAL LLC, Marshalltown, IA (US)

( * ) Notice: Subject to any disclaimer, the term of this patent is extended or adjusted under 35 U.S.C. 154(b) by 35 days.

(21) Appl. No.: 16/829,736

(22) Filed: Mar. 25, 2020

(65) Prior Publication Data

US 2021/0301844 A1 Sep. 30, 2021

(51) Int. Cl.
*F15D 1/02* (2006.01)

(52) U.S. Cl.
CPC ..... *F15D 1/025* (2013.01)

(58) Field of Classification Search
CPC ..... F16K 47/08; F16K 47/12; F16K 47/14
USPC ..... 138/41
See application file for complete search history.

(56) References Cited

U.S. PATENT DOCUMENTS

| | | | |
|---|---|---|---|
| 4,456,033 A | 6/1984 | Kay et al. | |
| 6,382,253 B1 | 5/2002 | McCarty et al. | |
| 10,487,961 B2 | 11/2019 | Eilers et al. | |
| 2007/0240774 A1 | 10/2007 | McCarty | |
| 2009/0183790 A1 | 7/2009 | Moore | |
| 2014/0014493 A1 | 1/2014 | Ryan | |
| 2016/0341335 A1 | 11/2016 | Adams et al. | |
| 2018/0112800 A1 | 4/2018 | Griffin, Jr. et al. | |
| 2018/0117872 A1* | 5/2018 | Abu Al-Rub | B32B 9/041 |
| 2018/0187984 A1* | 7/2018 | Manzo | F28F 7/02 |
| 2019/0145298 A1* | 5/2019 | Abu Al-Rub | B01D 53/34 55/523 |
| 2019/0274925 A1* | 9/2019 | Vlahinos | B01L 9/00 |
| 2020/0033070 A1* | 1/2020 | Vlahinos | B01F 5/0645 |

(Continued)

FOREIGN PATENT DOCUMENTS

| | | | |
|---|---|---|---|
| WO | WO-0169114 | A1 | 9/2001 |
| WO | WO-2008079593 | A2 | 7/2008 |
| WO | WO-2017018173 | A1 | 2/2017 |

OTHER PUBLICATIONS

Inline Diffusers Product Bulletin dated Mar. 2013, 8 pgs.

(Continued)

*Primary Examiner* — Craig M Schneider
*Assistant Examiner* — David R Deal
(74) *Attorney, Agent, or Firm* — Marshall, Gerstein & Borun LLP

(57) ABSTRACT

A diffuser has a cylindrical wall and an arcuate end wall located at an end of the cylindrical wall. The cylindrical wall has a first lattice structure formed of a first plurality of triply periodic surfaces that are periodic in cylindrical coordinates, the first lattice structure having a plurality of passages that extend between an inner surface of the cylindrical wall and an outer surface of the cylindrical wall. The arcuate end wall has a second lattice structure formed of a second plurality of triply periodic surfaces that are periodic in spherical coordinates, the second lattice structure having a plurality of passages that extend between an inner surface of the arcuate end wall and an outer surface of the arcuate end wall.

20 Claims, 13 Drawing Sheets

(56) References Cited

U.S. PATENT DOCUMENTS

| | | | | |
|---|---|---|---|---|
| 2020/0171753 | A1* | 6/2020 | Satko | A61B 17/866 |
| 2020/0173291 | A1* | 6/2020 | Rathay | F01D 5/187 |
| 2020/0197751 | A1* | 6/2020 | Madson | A63B 37/0038 |
| 2020/0215480 | A1* | 7/2020 | Roy | B01D 63/066 |
| 2020/0222839 | A1* | 7/2020 | Kelly | D01D 5/003 |
| 2020/0309492 | A1* | 10/2020 | Flater, IV | F42B 12/207 |
| 2020/0365290 | A1* | 11/2020 | Fisher | G21C 3/30 |
| 2020/0391290 | A1* | 12/2020 | Stoner | B33Y 50/00 |

OTHER PUBLICATIONS

8580 Product Bulletin dated Aug. 2017, 16 pgs.
A31D Instructional Manual dated Jun. 2017, 28 pgs.
V260 Instructional Manual dated Jul. 2017, 16 pgs.
International Search Report for PCT/US2018/050580 dated Dec. 11, 2018, 6 pgs.
Written Opinion for PCT/US2018/050580 dated Dec. 11, 2018, 10 pgs.

* cited by examiner

DIFFUSER

FIELD OF THE DISCLOSURE

This disclosure relates generally to diffusers and, more particularly, to vent diffusers and in-line vent diffusers.

BACKGROUND

Diffusers are used to condition the flow of fluid passing through or being expelled from a pipe or other device and reduce noise, cavitation, and turbulence. Some diffusers will have a plurality of passages formed through a circumferential wall, which are used to reduce the noise produced as the fluid passes through the diffuser. The passages are spaced specifically such that the jets of gas that are produced as the gas exits the passages do not converge and produce aerodynamic noise. For solid diffusers used in applications where the process conditions produce aerodynamic noise, drilled holes through the circumferential wall of the diffuser are typically used to form the passages. However, drilled hole diffusers are very cumbersome, time consuming, and costly to produce. Some drilled hole diffusers may contain thousands of holes and the only real feasible way to produce the passages was to drill them.

In addition to the spacing of the passages on the outer surface of the diffuser, aerodynamic noise can also be reduced by providing a tortured, or non-linear, flow path for the passages or by varying the cross-sectional area of the passages as they pass through the wall of the diffuser. However, with drilled holes through a solid diffuser, creating passages having a non-linear flow path or having a variable cross-sectional area is not possible.

BRIEF SUMMARY OF THE DISCLOSURE

In accordance with one exemplary aspect of the present invention, a diffuser comprises a cylindrical wall having a first end and a second end, opposite the first end, and an arcuate end wall located at the second end of the cylindrical wall. The cylindrical wall has a first lattice structure formed of a first plurality of triply periodic surfaces that are periodic in cylindrical coordinates, the first lattice structure having a plurality of passages that extend between an inner surface of the cylindrical wall and an outer surface of the cylindrical wall. The arcuate end wall has a second lattice structure formed of a second plurality of triply periodic surfaces that are periodic in spherical coordinates, the second lattice structure having a plurality of passages that extend between an inner surface of the arcuate end wall and an outer surface of the arcuate end wall.

In further accordance with any one or more of the foregoing exemplary aspects of the present invention, a diffuser may further include, in any combination, any one or more of the following preferred forms.

In one preferred form, the first plurality of triply periodic surfaces and the second plurality of triply periodic surfaces are gyroid.

In another preferred form, the first plurality of triply periodic surfaces are oriented such that there are no unimpeded linear radial flow paths in the plurality of passages through the cylindrical wall and the second plurality of triply periodic surfaces are oriented such that there are no unimpeded linear radial flow paths in the plurality of passages through the arcuate end wall.

In another preferred form, the diffuser is an inline diffuser and comprises a first flange adjacent the first end of the cylindrical wall, an outlet head adjacent the outer surface of the cylindrical wall and secured to the cylindrical wall, and a second flange attached to the outlet head.

In accordance with another exemplary aspect of the present invention, a diffuser comprises a first wall having a first end and a second end, opposite the first end, a second wall having a first end and a second end, opposite the first end, and an annular cavity separating the first wall and the second wall. The first wall has a first lattice structure formed of a first plurality of triply periodic surfaces, the first lattice structure having a plurality of passages that extend between an inner surface of the first wall and an outer surface of the first wall. The second wall having a second lattice structure formed of a second plurality of triply periodic surfaces, the second lattice structure having a plurality of passages that extend between an inner surface of the second wall and an outer surface of the second wall.

In further accordance with any one or more of the foregoing exemplary aspects of the present invention, a diffuser may further include, in any combination, any one or more of the following preferred forms.

In one preferred form, the first lattice structure has a different volume fraction than the second lattice structure.

In another preferred form, the first lattice structure has a different unit cell size than the second lattice structure.

In another preferred form, the first wall is cylindrical and the first plurality of triply periodic surfaces are periodic in cylindrical coordinates and the second wall is cylindrical and the second plurality of triply periodic surfaces are periodic in cylindrical coordinates.

In another preferred form, a first arcuate end wall is located at the second end of the first wall and has a third lattice structure formed of a third plurality of triply periodic surfaces that are periodic in spherical coordinates, the third lattice structure having a plurality of passages that extend between an inner surface of the first arcuate end wall and an outer surface of the first arcuate end wall. A second arcuate end wall is located at the second end of the second wall and has a fourth lattice structure formed of a fourth plurality of triply periodic surfaces that are periodic in spherical coordinates, the fourth lattice structure having a plurality of passages that extend between an inner surface of the second arcuate end wall and an outer surface of the second arcuate end wall.

In another preferred form, the first wall is arcuate and the first plurality of triply periodic surfaces are periodic in spherical coordinates and the second wall is arcuate and the second plurality of triply periodic surfaces are periodic in spherical coordinates.

In another preferred form, the first wall is cylindrical and the first plurality of triply periodic surfaces are periodic in cylindrical coordinates and the second wall is spherical and the second plurality of triply periodic surfaces are periodic in spherical coordinates.

In another preferred form, the first plurality of triply periodic surfaces and the second plurality of triply periodic surfaces are gyroid.

In another preferred form, the first plurality of triply periodic surfaces are oriented such that there are no unimpeded linear radial flow paths in the plurality of passages through the first wall and the second plurality of triply periodic surfaces are oriented such that there are no unimpeded linear radial flow paths in the plurality of passages through the second wall.

In accordance with another exemplary aspect of the present invention, a diffuser comprises a wall having a first end and a second end, opposite the first end. The wall has a lattice structure that is formed of a plurality of triply periodic surfaces, the lattice structure having a varying unit cell size and a plurality of passages that extend between an inner surface of the wall and an outer surface of the wall.

In further accordance with any one or more of the foregoing exemplary aspects of the present invention, a diffuser may further include, in any combination, any one or more of the following preferred forms.

In one preferred form, the wall is cylindrical and the triply periodic surfaces are periodic in cylindrical coordinates.

In another preferred form, the unit cell size of the lattice structure changes from the inner surface of the wall to the outer surface.

In another preferred form, the wall is cylindrical and the unit cell size of the lattice structure changes from the first end of the wall to the second end.

In another preferred form, the diffuser comprises an arcuate end wall located at the second end of the wall and having a second lattice structure formed of a second plurality of triply periodic surfaces that are periodic in spherical coordinates. The second lattice structure has a plurality of passages that extend between an inner surface of the arcuate end wall and an outer surface of the arcuate end wall and the unit cell size of the second lattice structure changes from the inner surface of the arcuate end wall to the outer surface of the arcuate end wall.

In another preferred form, the wall is spherical and the triply periodic surfaces are periodic in spherical coordinates.

In another preferred form, the unit cell size of the lattice structure changes from the inner surface of the wall to the outer surface

DETAILED DESCRIPTION

The example diffusers shown and described herein have walls that include lattice structures formed of triply periodic surfaces to form passages through the lattice structures for the flow of fluid. Some examples are single stage and have single lattice structures that have a changing unit cell size and/or a changing volume fraction through the thickness and/or length of the lattice structure. Other examples are multi-stage and have multiple lattice structures with recovery volumes between the stages. The multiple lattice structures can also have changing unit cell sizes and/or a changing volume fractions through the thickness and/or length of the lattice structures and/or the multiple lattice structures could be formed of different triply periodic surfaces in each stage.

Figure 1:
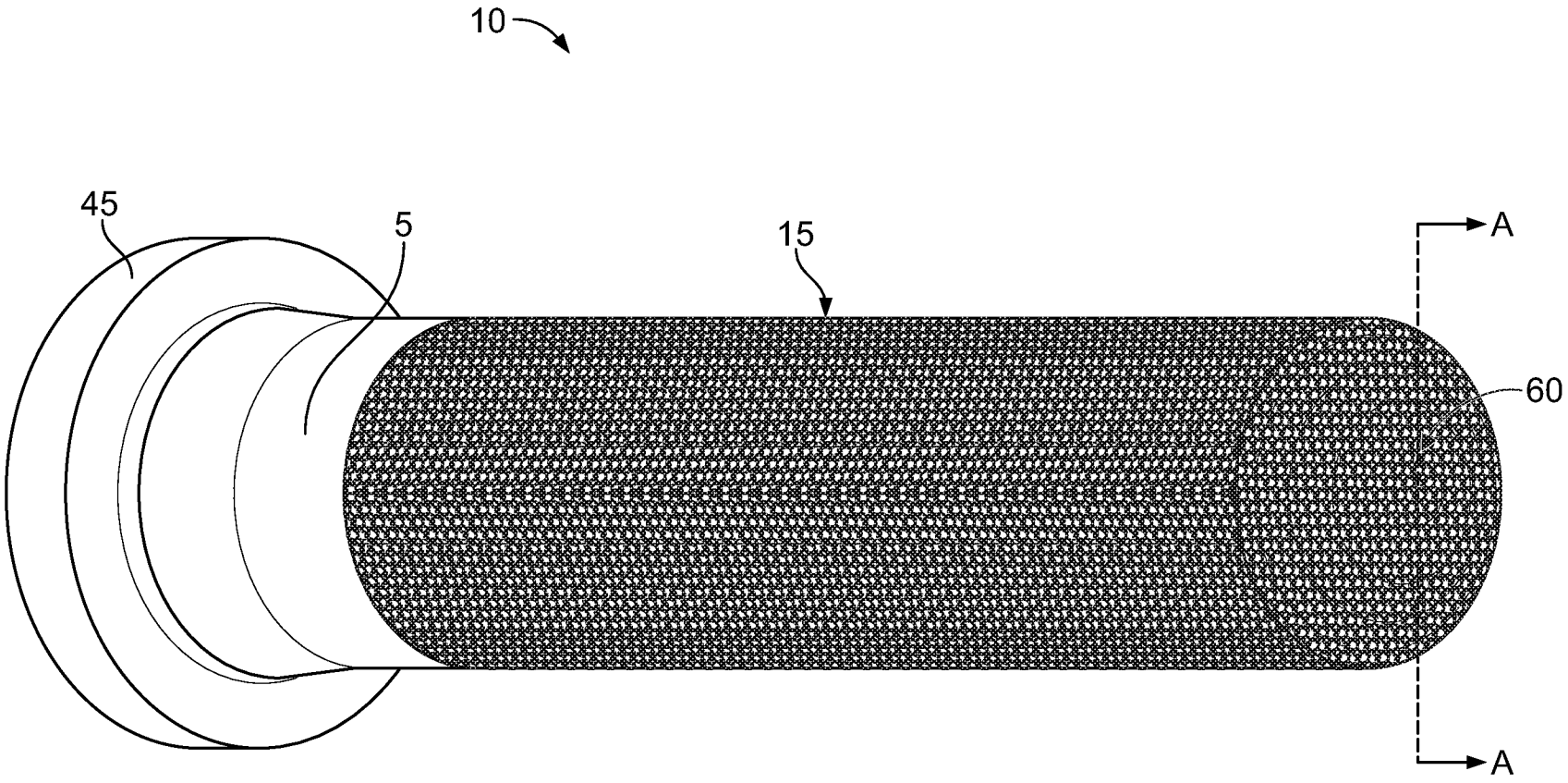
FIG. 1 is a perspective view of an example vent diffuser.
Figures 2, 3:
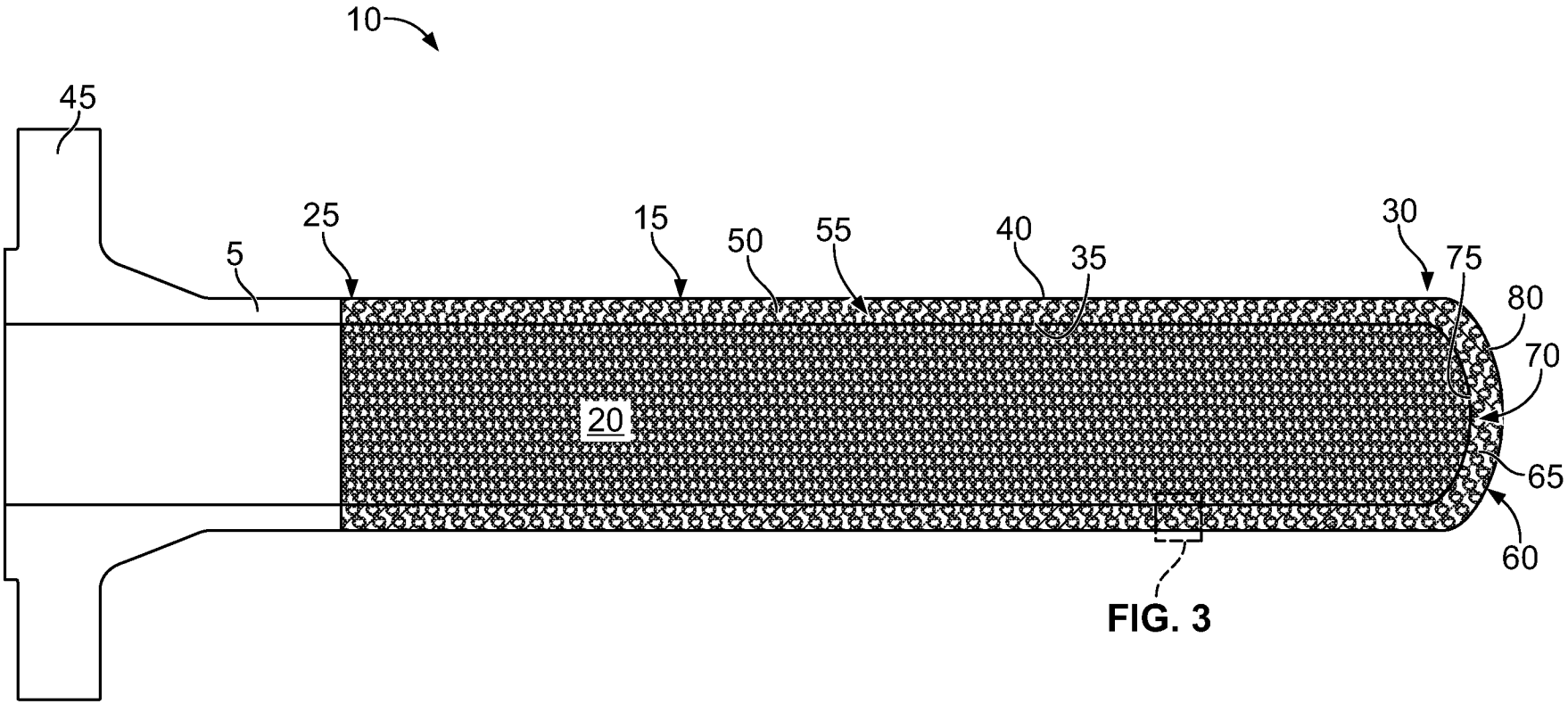
FIG. 2 is a cross-sectional view of the vent diffuser of FIG. 1, taken along line A-A in FIG. 1.
FIG. 3 is an enlarged view of a portion of the lattice structure of the vent diffuser of FIG. 2.
Figure 3:
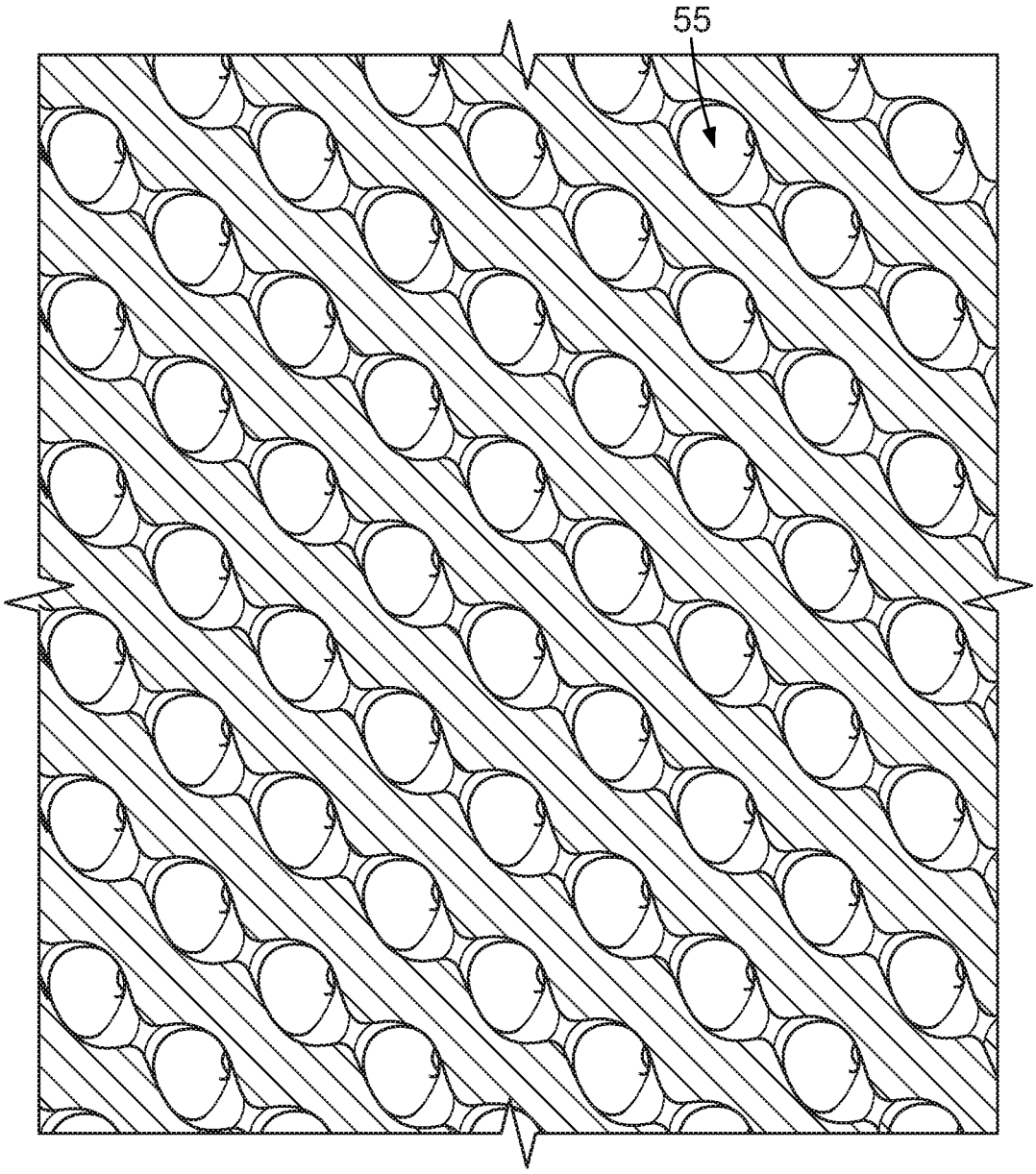

Referring to FIGS. 1-3, a first example diffuser is shown in the form of a vent diffuser 10. Vent diffuser 10 has a generally cylindrical solid wall 5 and a flange 45 extending from solid wall 5 to connect vent diffuser 10 to a pipe or other device to be vented. A cylindrical wall 15 extends from the solid wall 5 at a first end 25 of cylindrical wall 15 and forms a hollow central bore 20. Solid wall 5 can be manufactured as a separate part and attached to first end 25 of cylindrical wall 15, such as by welding or other suitable process, or solid wall 5 and cylindrical wall 15 can be manufactured as one single, integral, unitary part using Additive Manufacturing Technology, as described below, or any other suitable process. Cylindrical wall 15 has a first lattice structure 50 formed of a plurality of triply periodic surfaces that form a plurality of passages 55 extending between an inner surface 35 and outer surface 40 of cylindrical wall 15. Passages 55 can be used to characterized and/or condition fluid flowing through vent diffuser 10 by, for example, reducing the pressure of the fluid as it flows through passages 55.

An arcuate end wall 60 is located at a second end 30 of cylindrical wall 15, opposite first end 25. Arcuate end wall 60 can have a semi-spherical shape or other curved shape and has a second lattice structure 65 formed of a plurality of triply periodic surfaces that form a plurality of passages 70 extending between an inner surface 75 and an outer surface 80 of end wall 60. Like passages 55, passages 70 can be used to characterized and/or condition fluid flowing through vent diffuser 10 by, for example, reducing the pressure of the fluid as it flows through passages 70. Arcuate end wall 60 can be manufactured as a separate part and attached to second end 30 of cylindrical wall 15, such as by welding or other suitable process, or cylindrical wall 15 and end wall 60 can be manufactured as one single, integral, unitary part using Additive Manufacturing Technology, as described below, or any other suitable process.

Vent diffuser 10, solid wall 5, cylindrical wall 15, end wall 60, first lattice structure 50, and/or second lattice structure 65 can be manufactured using Additive Manufacturing Technology, such as direct metal laser sintering, full melt powder bed fusion, etc. Using an Additive Manufacturing Technology process, the 3-dimensional design of the desired structure is divided into multiple layers, for example layers approximately 20-50 microns thick. A powder bed, such as a powder based metal, is then laid down representing the first layer of the design and a laser or electron beam sinters together the design of the first layer. A second powder bed, representing the second layer of the design, is then laid down over the first sintered layer and the second layer is sintered together. This continues layer after layer to form the completed structure. Using an Additive Manufacturing Technology process to manufacture diffusers allows the freedom to produce passages having various shapes, geometries, and features that are not possible using current standard casting or drilling techniques. The entire vent diffuser 10 could be manufactured as a single, integral, unitary part using Additive Manufacturing Technology or one or more parts of vent diffuser 10 could be manufactured using Additive Manufacturing Technology and then assembled together.

In the example shown in FIGS. 1-3, first lattice structure 50 and second lattice structure 65 can be formed by triply periodic surfaces that are gyroid or gyroid-like. A gyroid is an infinitely connected triply periodic minimal surface that contains no straight lines or planar symmetries.

Figure 4:
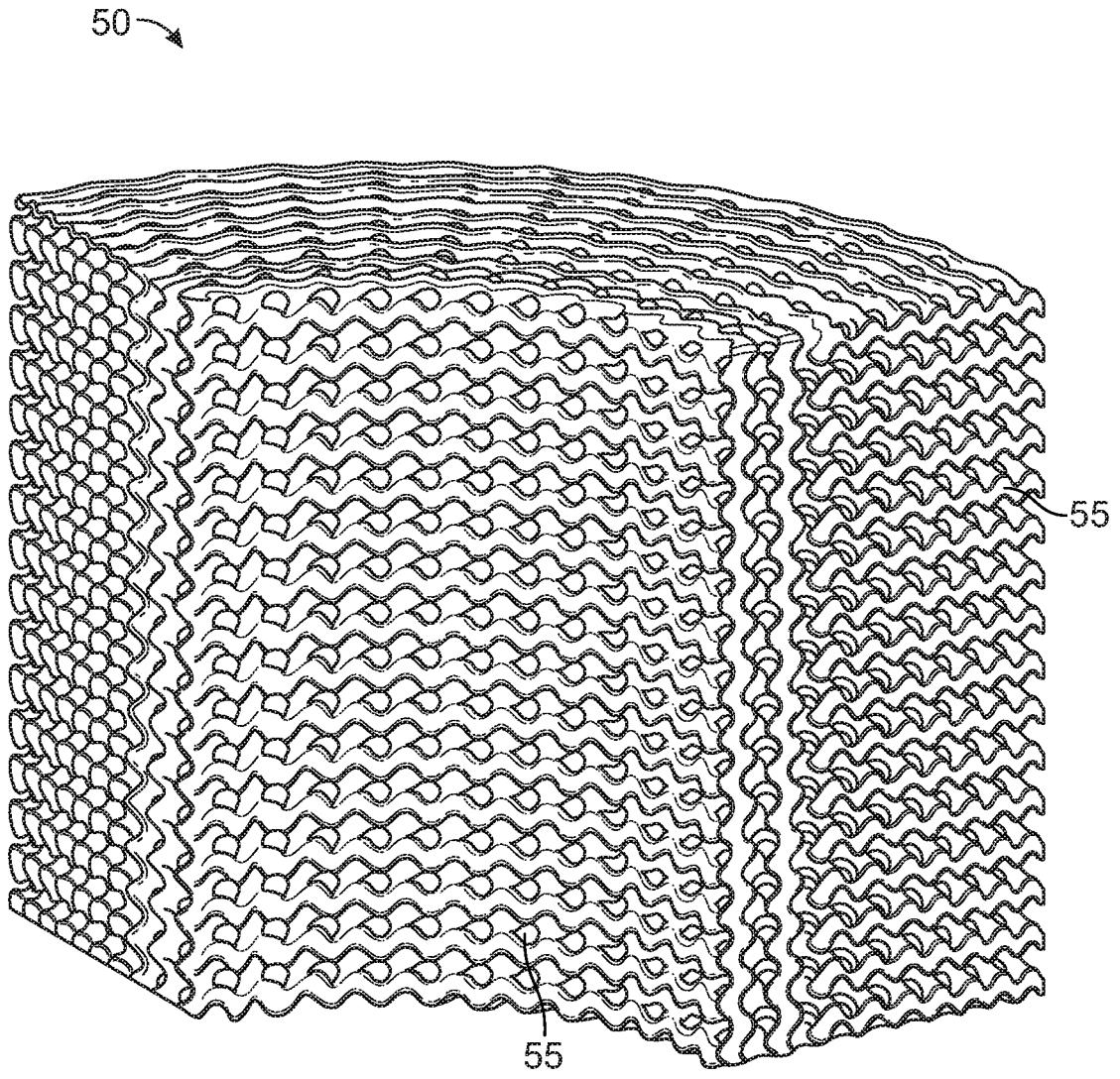
FIG. 4 is a partial perspective view of an example gyroid-like lattice structure that is periodic in cylindrical coordinates that can be used in the vent diffuser of FIG. 2.
Figure 5:
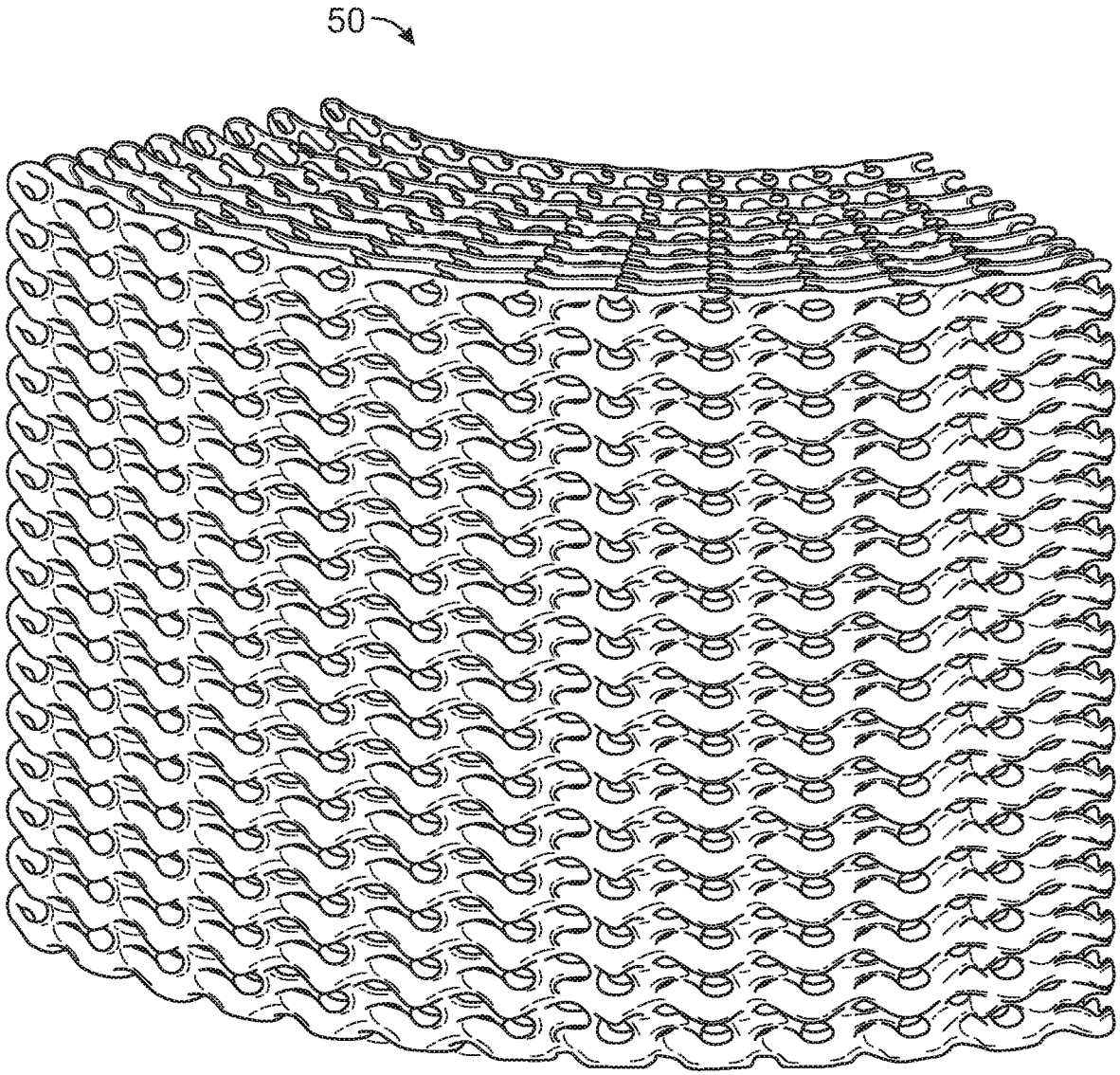
FIG. 5 is another perspective view of the lattice structure of FIG. 4.

For example, as shown in FIGS. 4-5, first lattice structure 50 could be formed by gyroid or gyroid-like triply periodic surfaces that are periodic in cylindrical coordinates and can be represented by the equation:

$$\cos(\omega_r\sqrt{x^2+y^2}+\phi_r)\cos(\omega_z z+\phi_z)\cos(\omega_\theta \tan^{-1}(y/x)+\phi_\theta)+\sin(\omega_r\sqrt{x^2+y^2}+\phi_r)\sin(\omega_z z+\phi_z)\sin(\omega_\theta \tan^{-1}(y/x)+\phi_e)=0$$

Other possible cylindrically periodic gyroid-like triply periodic surfaces that can be used to form first lattice structure 50 can be represented by the equation:

$$\cos(\omega_r\sqrt{x^2+y^2}+\phi_r)\sin(\omega_z z\phi_z)+\cos(\omega_z z+\phi_z)\sin(\omega_\theta \tan^{-1}(y/x)+\phi_\theta)\sin(\omega_r\sqrt{x^2+y^2}+\phi_r)+\cos(\omega_\theta \tan^{-1}(y/x)+\phi_\theta)\sin(\omega_r\sqrt{x^2+y^2}+\phi_r)=0$$

In the above equations, the ω values control the frequency in that direction (r for radial, z for axial, and θ for tangential) and the ϕ values control the phase shift of where in the part the periodic surfaces begin. The gyroid-like triply periodic surfaces represented by the equations above are cylindrical lattice structures and therefore, can be used to form cylindrical wall 15.

Figure 6:
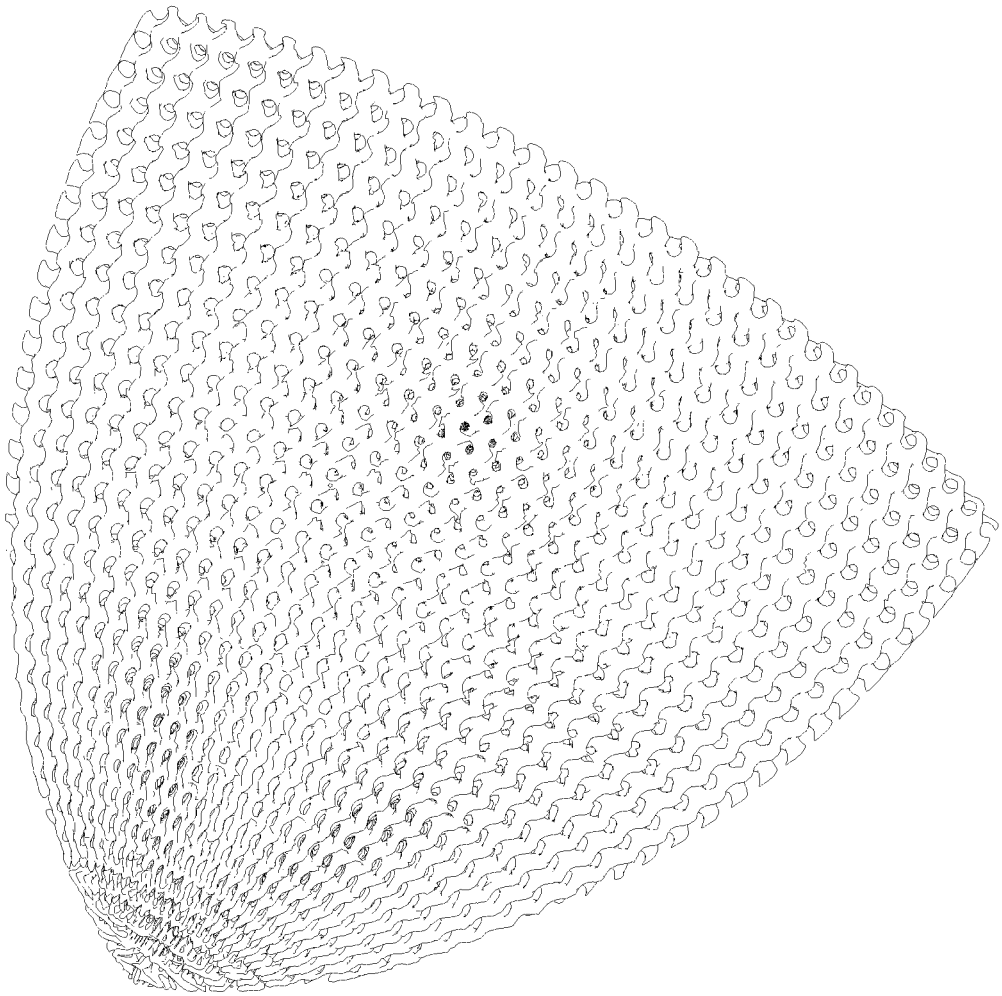
FIG. 6 is a partial perspective view of another example gyroid-like lattice structure that is periodic in spherical coordinates.
Figure 7:
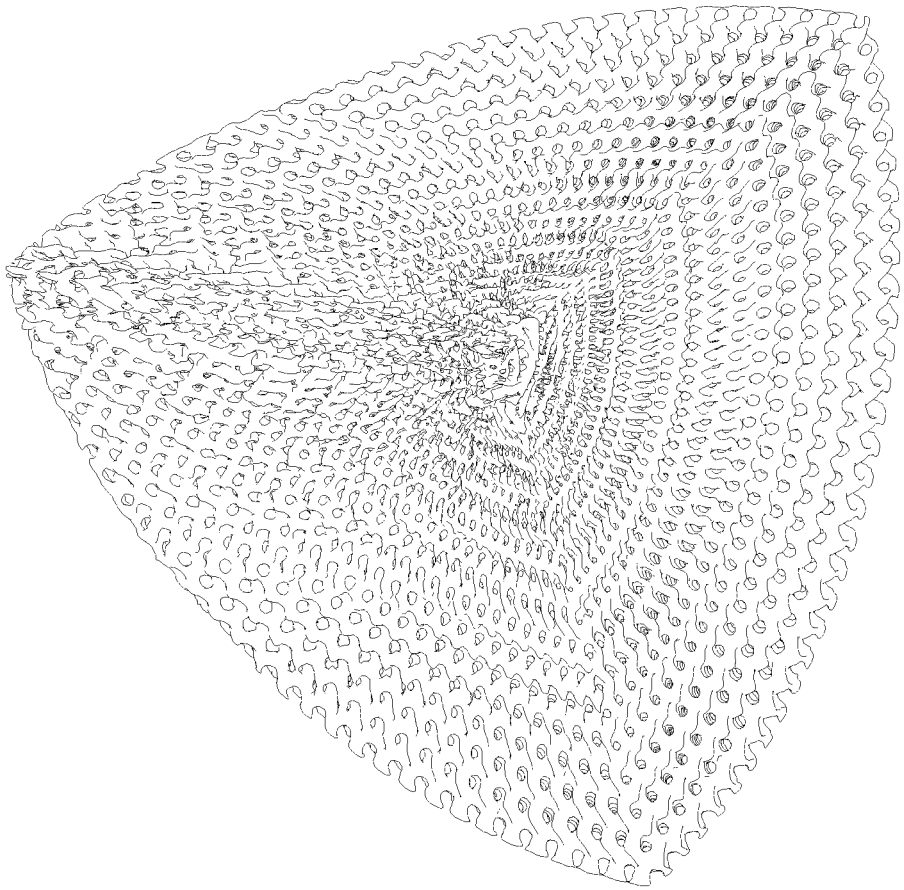
FIG. 7 is another perspective view of the lattice structure of FIG. 6.

In addition, as shown in FIGS. 6-7, second lattice structure 65 could be formed by gyroid or gyroid-like triply periodic surfaces that are periodic in spherical coordinates and can be represented by the equation:

$$\cos\left(\omega_r\sqrt{x^2+y^2+z^2}+\phi_r\right)\sin\left(\omega_\varphi\cos^{-1}\left(\frac{2}{\sqrt{x^2+y^2+z^2}}\right)+\phi_\varphi\right)+\cos\left(\omega_\varphi\cos^{-1}\left(\frac{z}{\sqrt{x^2+y^2+z^2}}\right)+\phi_\varphi\right)\sin(\omega_\theta\tan^{-1}(y/x)+\phi_\theta)+\cos(\omega_\theta\tan^{-1}(y/x)+\phi_\theta)\sin\left(\omega_r\sqrt{x^2+y^2+z^2}+\phi_r\right)=0$$

Again, in the above equation, the ω values control the frequency in that direction (r for radial, z for axial, and θ for tangential) and the ϕ values control the phase shift of where in the part the periodic surfaces begin.

Whether first and second lattice structures 50, 65 are formed using gyroid or gyroid-like triply periodic surfaces or other triply periodic surfaces, passages 55, 70 formed through first and second lattice structures 50, 65 will have entirely arcuate surfaces. In addition, the triply periodic surfaces of first and second lattice structures 50, 65 are also preferably oriented so that there are no unimpeded radial flow paths in passages 55, 70 through cylindrical wall 15 or end wall 60. The arcuate surfaces provide losses to reduce the pressure of the fluid flow through vent diffuser 10 and minimize the turbulence and separation that can occur using other vent types. Therefore, noise produced by fluid flowing through first and second lattice structures 50, 65 is minimized.

First and second lattice structures 50, 65 can have any volume fraction or ratio desired for a particular application and the volume fraction can be constant throughout the lattice or can vary radially and/or longitudinally along the lattice, for example, by stretching or compressing the triply periodic surfaces in the radial and/or longitudinal direction. In addition, first and second lattice structures 50, 65 can also have any unit cell size desired for a particular application and the unit cell size can also be constant throughout the lattice or can vary radially and/or longitudinally along the lattice, for example, by varying the thickness of the walls forming the triply periodic surfaces in the radial and/or longitudinal directions.

Figure 8:
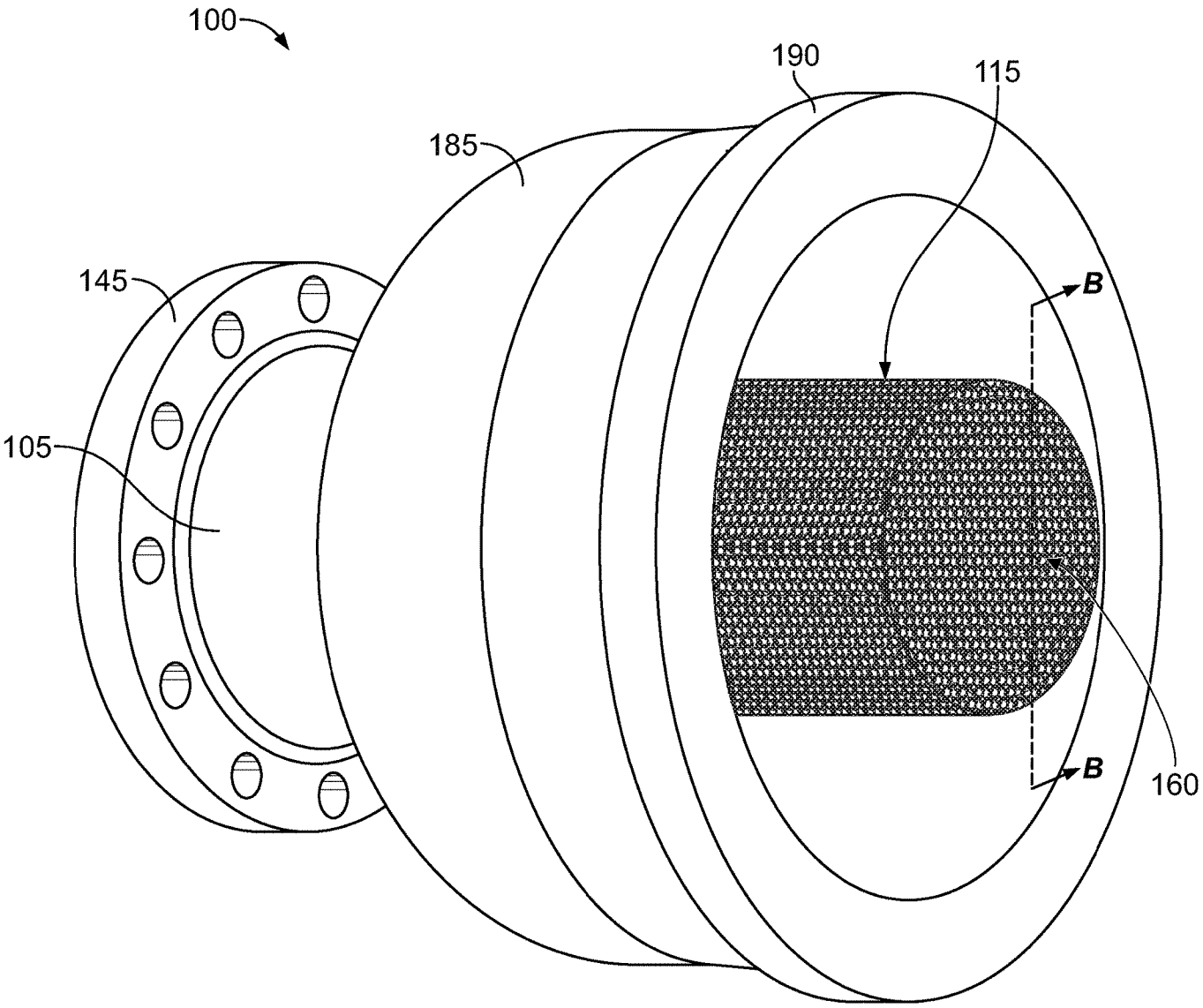
FIG. 8 is a perspective view of an example in-line vent diffuser.
Figure 9:
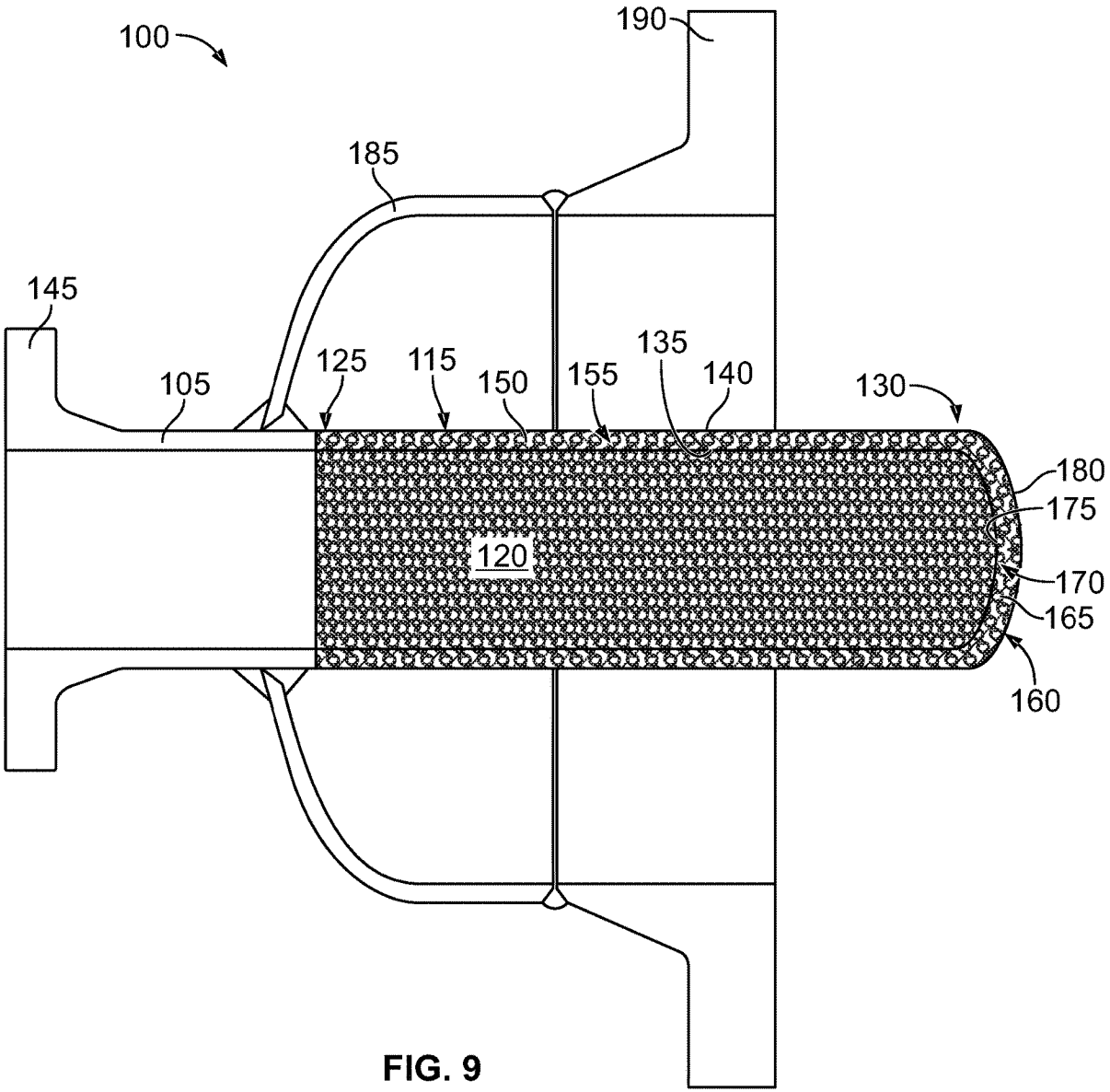
FIG. 9 is a cross-sectional view of a the in-line vent diffuser of FIG. 8 taken along line B-B of FIG. 8.

Referring to FIGS. 8-9, another example diffuser is shown in the form of an inline diffuser 100. Inline diffuser 100 has a generally cylindrical solid wall 105 and a first flange 145 extending from solid wall 105 to connect inline diffuser 100 to a pipe or other device to be vented. A cylindrical wall 115 extends from solid wall 105 at a first end 125 of cylindrical wall 115 forming a hollow central bore 120. Cylindrical wall 115 has a first lattice structure 150 formed of a plurality of triply periodic surfaces that form a plurality of passages 155 extending between inner surface 135 and outer surface 140 of cylindrical wall 115. Passages 155 can be used to characterized and/or condition fluid flowing through inline diffuser 100 by, for example, reducing the pressure of the fluid as it flows through passages 155.

An outlet head 185 is secured to solid wall 105, is positioned adjacent outer surface 140 and first lattice structure 150, and at least partially surrounds first lattice structure 150. A second flange 190 is attached to outlet head 185, or second flange 190 and outlet head 185 could be a single, integral, unitary part, to connect inline diffuser 100 to another pipe or other device.

An arcuate end wall 160 is located at a second end 130 of cylindrical wall 115, opposite first end 125. Arcuate end wall 160 can have a semi-spherical shape or other curved shape and has a second lattice structure 165 formed of a plurality of triply periodic surfaces that form a plurality of passages 170 extending between an inner surface 175 and an outer surface 180 of end wall 160. Like passages 155, passages 170 can be used to characterized and/or condition fluid flowing through inline diffuser 100 by, for example, reducing the pressure of the fluid as it flows through passages 170. Arcuate end wall 160 can be manufactured as a separate part and attached to second end 130 of cylindrical wall 115, such as by welding or other suitable process, or cylindrical wall 115 and end wall 160 can be manufactured as one single, integral, unitary part using Additive Manufacturing Technology, as described above, or any other suitable process.

The entire inline diffuser 100 could be manufactured as a single, integral, unitary part using Additive Manufacturing Technology or one or more parts of inline diffuser 100 could be manufactured using Additive Manufacturing Technology and then assembled together.

In the example shown in FIGS. 8-9, first lattice structure 150 and second lattice structure 165 can be formed by triply periodic surfaces that are gyroid or gyroid-like. For example, first lattice structure 150 could be formed by gyroid or gyroid-like triply periodic surfaces that are periodic in cylindrical coordinates and second lattice structure 165 could be formed by gyroid or gyroid-like triply periodic surfaces that are periodic in spherical coordinates, as discussed above.

Whether first and second lattice structures 150, 165 are formed using gyroid or gyroid-like triply periodic surfaces or other triply periodic surfaces, passages 155, 170 formed through first and second lattice structures 150, 165 will have entirely arcuate surfaces. In addition, the triply periodic surfaces of first and second lattice structures 150, 165 are also preferably oriented so that there are no unimpeded radial flow paths in passages 155, 170 through cylindrical wall 115 or end wall 160. The arcuate surfaces provide losses to reduce the pressure of the fluid flow through inline diffuser 100 and minimize the turbulence and separation that can occur using other vent types. Therefore, noise produced by fluid flowing through first and second lattice structures 150, 165 is minimized.

First and second lattice structures 150, 165 can have any volume fraction or ratio desired for a particular application and the volume fraction can be constant throughout the lattice or can vary radially and/or longitudinally along the lattice, for example, by stretching or compressing the triply periodic surfaces in the radial and/or longitudinal direction. In addition, first and second lattice structures 150, 165 can also have any unit cell size desired for a particular application and the unit cell size can also be constant throughout the lattice or can vary radially and/or longitudinally along the lattice, for example, by varying the thickness of the walls forming the triply periodic surfaces in the radial and/or longitudinal directions.

Figure 10:
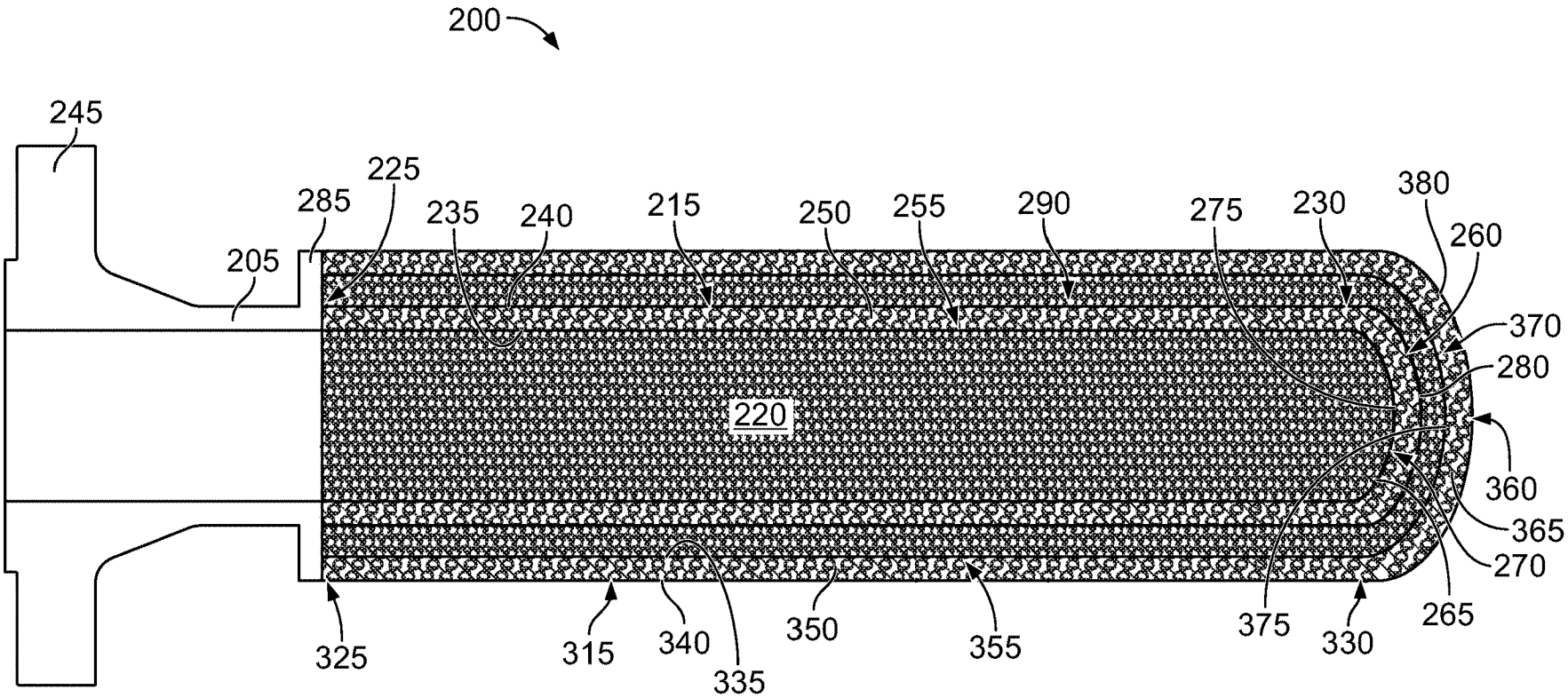
FIG. 10 is a cross-sectional view of a second example vent diffuser.

Referring to FIG. 10, a second example vent diffuser 200 is shown. Vent diffuser 200 has a generally cylindrical solid wall 205, a first flange 245 extending from solid wall 205 to connect vent diffuser 200 to a pipe or other device to be vented, and a second flange 285 extending from solid wall 205 and spaced apart from first flange 245. A first wall 215, which in the example shown is cylindrical, extends from solid wall 205, adjacent second flange 285 and forms a hollow central bore 220. First wall 215 has a first lattice structure 250 formed of a first plurality of triply periodic surfaces that form a plurality of passages 255 extending between inner surface 235 and outer surface 240 of first wall 215. Passages 255 can be used to characterized and/or condition fluid flowing through vent diffuser 200 by, for example, reducing the pressure of the fluid as it flows through passages 255. A second wall 315, which in the example shown in cylindrical, extends from second flange 285 at a first end 325, is coaxial with first wall 215, and surrounds first wall 215. Second wall 315 has a second lattice structure 350 formed of a second plurality of triply periodic surfaces that form a plurality of passages 355 extending between inner surface 335 and outer surface 340 of second wall 315. Passages 355 can be used to further characterized and/or condition fluid flowing through first wall 215 by, for example, reducing the pressure of the fluid as it flows through passages 355. An annular cavity 290 completely surrounds first wall 215 and separates first wall 215 and second wall 315 to form a recovery plenum between first wall 215 and second wall 315.

A first arcuate end wall 260 can be located at a second end 230 of first wall 215, opposite first end 225. First arcuate end wall 260 can have a semi-spherical shape or other curved shape and has a third lattice structure 265 formed of a third plurality of triply periodic surfaces that form a plurality of passages 270 extending between an inner surface 275 and an outer surface 280 of first end wall 260. Like passages 255, passages 270 can be used to characterized and/or condition fluid flowing through vent diffuser 200 by, for example, reducing the pressure of the fluid as it flows through passages 270. First arcuate end wall 260 can be manufactured as a separate part and attached to second end 230 of first wall 215, such as by welding or other suitable process, or first wall 215 and first end wall 260 can be manufactured as one single, integral, unitary part using Additive Manufacturing Technology, as described above, or any other suitable process.

A second arcuate end wall 360 can be located at a second end 330 of second wall 315, opposite first end 325. Second arcuate end wall 360 can have a semi-spherical shape or other curved shape and has a fourth lattice structure 365 formed of a plurality of triply periodic surfaces that form a plurality of passages 370 extending between an inner surface 375 and an outer surface 380 of second end wall 360. Like passages 355, passages 370 can be used to further characterized and/or condition fluid flowing through first wall 215 and first end wall 260 by, for example, reducing the pressure of the fluid as it flows through passages 370. Second arcuate end wall 360 can be manufactured as a separate part and attached to second end 330 of second wall 315, such as by welding or other suitable process, or second wall 315 and second end wall 360 can be manufactured as one single, integral, unitary part using Additive Manufacturing Technology, as described above, or any other suitable process.

An annular cavity 290 can also surround first end wall 260 and separate first end wall 260 and second end wall 360 to form a recovery plenum between first end wall 260 and second end wall 360.

The entire vent diffuser 200 could be manufactured as a single, integral, unitary part using Additive Manufacturing Technology or one or more parts of vent diffuser 200 could be manufactured using Additive Manufacturing Technology and then assembled together.

In the example shown in FIG. 10, first, second, third, and fourth lattice structures 250, 350, 265, 365 can be formed by triply periodic surfaces that are gyroid or gyroid-like. For example, first and second lattice structures 250, 350 could be formed by gyroid or gyroid-like triply periodic surfaces that are periodic in cylindrical coordinates and third and fourth lattice structures 265, 365 could be formed by gyroid or gyroid-like triply periodic surfaces that are periodic in spherical coordinates, as discussed above.

Whether first, second, third, and fourth lattice structures 250, 350, 265, 365 are formed using gyroid or gyroid-like triply periodic surfaces or other triply periodic surfaces, passages 255, 355, 270, 370 formed through first, second, third, and fourth lattice structures 250, 350, 265, 365 will have entirely arcuate surfaces. In addition, the triply periodic surfaces of first, second, third, and fourth lattice structures 250, 350, 265, 365 are also preferably oriented so that there are no unimpeded radial flow paths in passages 255, 355, 270, 370. The arcuate surfaces provide losses to reduce the pressure of the fluid flow through vent diffuser 200 and minimize the turbulence and separation that can occur using other vent types. Therefore, noise produced by fluid flowing through first, second, third, and fourth lattice structures 250, 350, 265, 365 is minimized.

First, second, third, and fourth lattice structures 250, 350, 265, 365 can have any volume fraction or ratio desired for a particular application and the volume fraction can be constant throughout the lattice or can vary radially and/or longitudinally along the lattice, for example, by stretching or compressing the triply periodic surfaces in the radial and/or longitudinal direction. In the particular example shown in FIG. 10, first lattice structure 250 of first wall 215 has a different volume fraction than second lattice structure 350 of second wall 315 and third lattice structure 265 of first end wall 260 has a different volume fraction than fourth lattice structure 365 of second end wall 360. In addition, first, second, third, and fourth lattice structures 250, 350, 265, 365 can also have any unit cell size desired for a particular application and the unit cell size can also be constant throughout the lattice or can vary radially and/or longitudinally along the lattice, for example, by varying the thickness of the walls forming the triply periodic surfaces in the radial and/or longitudinal directions. In the particular example shown in FIG. 10, first lattice structure 250 of first wall 215 has a different unit cell size than second lattice structure 350 of second wall 315 and third lattice structure 265 of first end wall 260 has a different unit cell size than fourth lattice structure 365 of second end wall 360.

Figure 11:
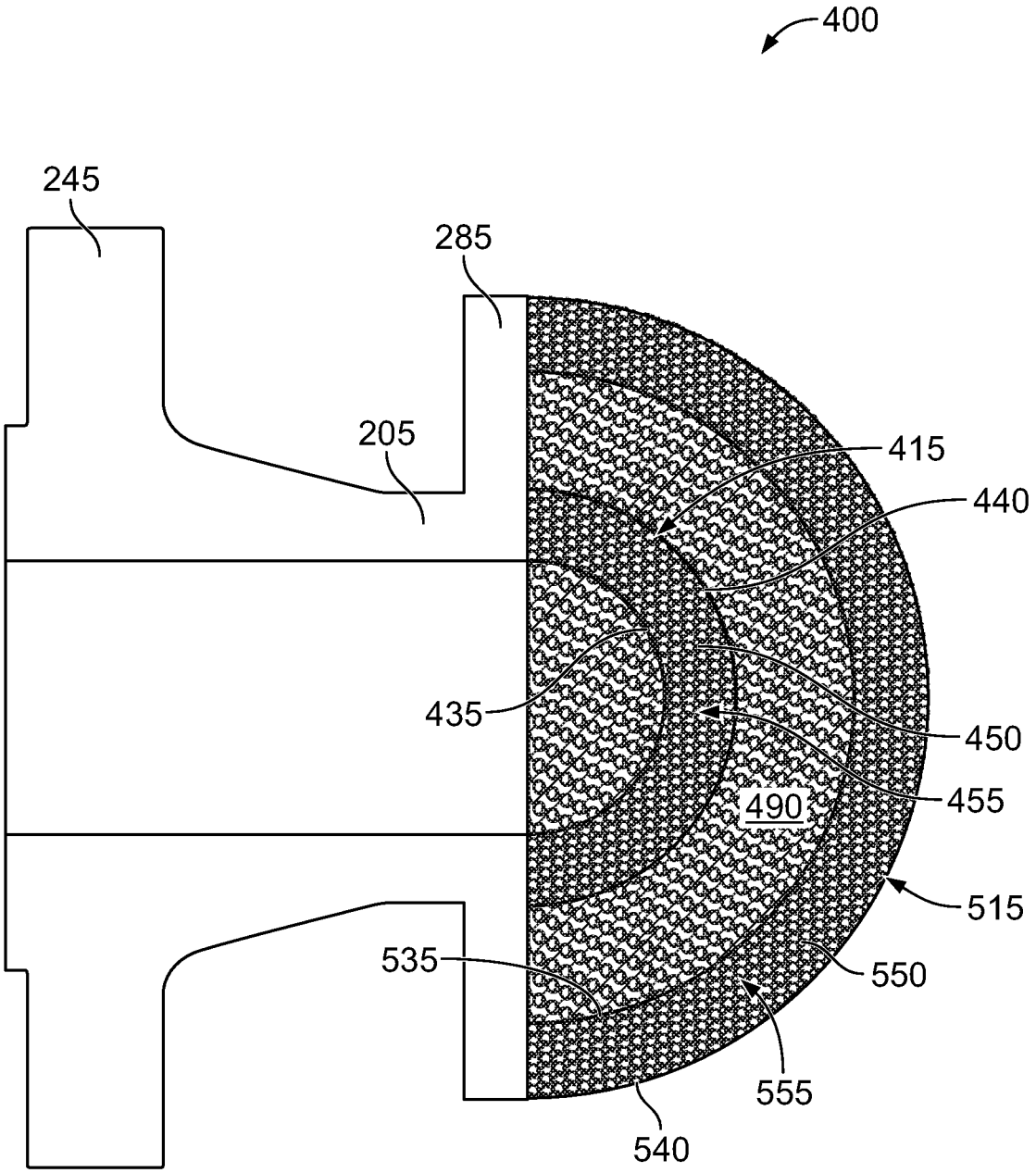
FIG. 11 is a cross-sectional view of a third example vent diffuser.

A third example vent diffuser 400 is shown in FIG. 11, which is another version of vent diffuser 200, except that the first and second walls 415, 515 are arcuate rather than cylindrical. In the example shown in FIG. 11, first wall 415 is arcuate, in the particular example shown it is semi-spherical, and has a first lattice structure 450 formed of a first plurality of triply periodic surfaces that form a plurality of passages 455 extending between inner surface 435 and outer surface 440 of first wall 415. Passages 455 can be used to characterized and/or condition fluid flowing through vent diffuser 400 by, for example, reducing the pressure of the fluid as it flows through passages 455. Second wall 515 is also arcuate, in the particular example shown it is semi-spherical, and surrounds first wall 415. Second wall 515 has a second lattice structure 550 formed of a second plurality of triply periodic surfaces that form a plurality of passages 555 extending between inner surface 535 and outer surface 540 of second wall 515. Passages 555 can be used to further characterized and/or condition fluid flowing through first wall 415 by, for example, reducing the pressure of the fluid as it flows through passages 555. Annular cavity 490 completely surrounds first wall 415 and separates first wall 415 and second wall 515 to form a recovery plenum between first wall 415 and second wall 515.

The entire vent diffuser 400 could be manufactured as a single, integral, unitary part using Additive Manufacturing Technology or one or more parts of vent diffuser 400 could be manufactured using Additive Manufacturing Technology and then assembled together.

In the example shown in FIG. 11, first and second lattice structures 450, 550 can be formed by triply periodic surfaces that are gyroid or gyroid-like. For example, first and second lattice structures 450, 550 could be formed by gyroid or gyroid-like triply periodic surfaces that are periodic in spherical coordinates, as discussed above.

Whether first and second lattice structures 450, 550 are formed using gyroid or gyroid-like triply periodic surfaces or other triply periodic surfaces, passages 455, 555 formed through first and second lattice structures 450, 550 will have entirely arcuate surfaces. In addition, the triply periodic surfaces of first and second lattice structures 450, 550 are also preferably oriented so that there are no unimpeded radial flow paths in passages 455, 555. The arcuate surfaces provide losses to reduce the pressure of the fluid flow through vent diffuser 400 and minimize the turbulence and separation that can occur using other vent types. Therefore, noise produced by fluid flowing through first and second lattice structures 450, 550 is minimized.

First and second lattice structures 450, 550 can have any volume fraction or ratio desired for a particular application and the volume fraction can be constant throughout the lattice or can vary radially along the lattice, for example, by stretching or compressing the triply periodic surfaces in the radial direction. In the particular example shown in FIG. 11, first lattice structure 450 of first wall 415 has a different volume fraction than second lattice structure 550 of second wall 515. In addition, first and second lattice structures 450, 550 can also have any unit cell size desired for a particular application and the unit cell size can also be constant throughout the lattice or can vary radially along the lattice, for example, by varying the thickness of the walls forming the triply periodic surfaces in the radial direction. In the particular example shown in FIG. 11, first lattice structure 450 of first wall 415 has a different unit cell size than second lattice structure 550 of second wall 515.

Figure 12:
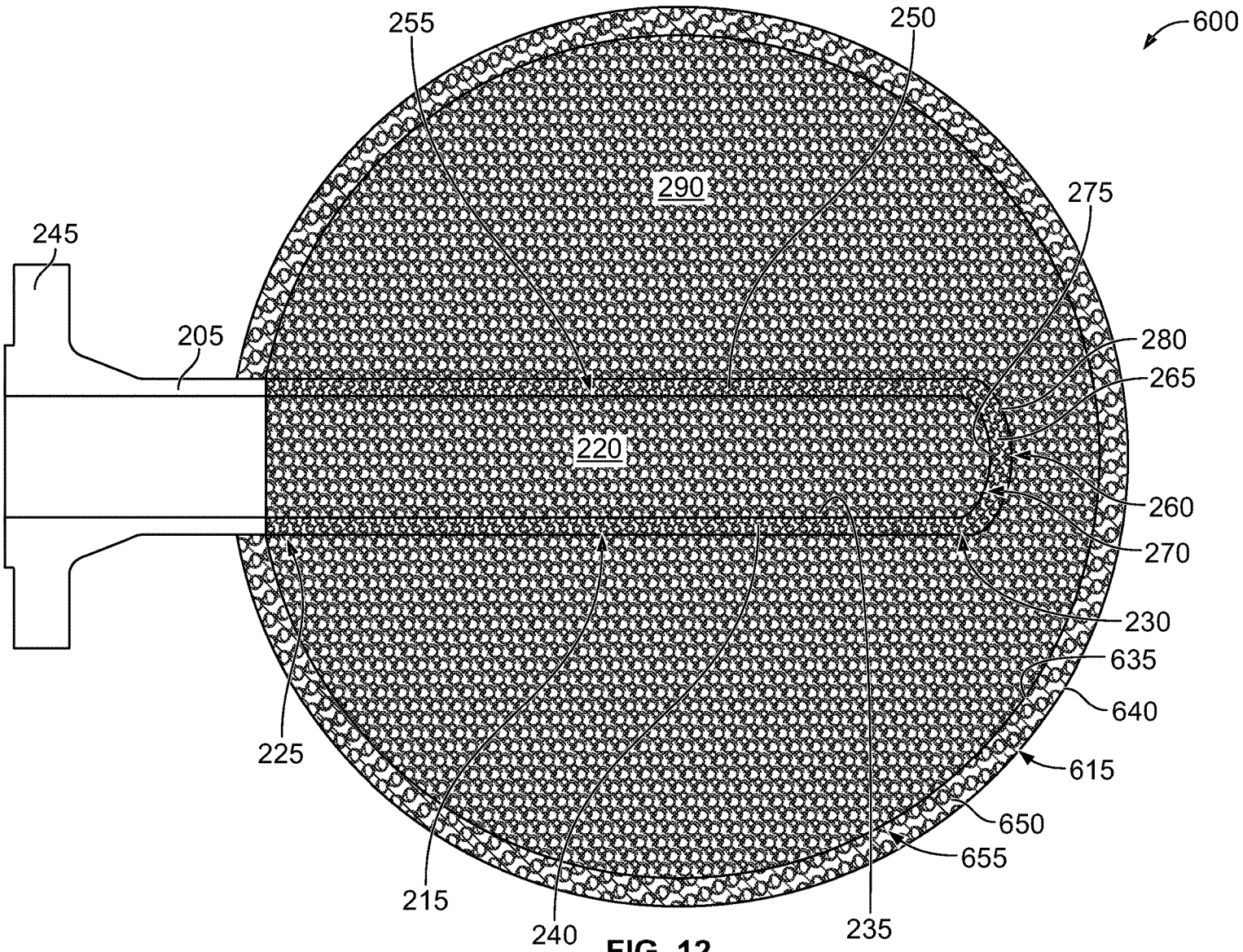
FIG. 12 is a cross-sectional view of a fourth example vent diffuser.

A fourth example vent diffuser 600 is shown in FIG. 12, which is another version of vent diffuser 200 having solid wall 205, first wall 215, and first arcuate end wall 260 as described above, except that second wall 615 is arcuate, rather than cylindrical. In the example shown in FIG. 12, second wall 615 is spherical and surrounds first wall 215. Second wall 615 has a second lattice structure 650 formed of a second plurality of triply periodic surfaces that form a plurality of passages 655 extending between inner surface 635 and outer surface 640 of second wall 615. Passages 655 can be used to further characterized and/or condition fluid flowing through first wall 215 by, for example, reducing the pressure of the fluid as it flows through passages 655. Annular cavity 290 completely surrounds first wall 215 and separates first wall 215 and second wall 615 to form a recovery plenum between first wall 215 and second wall 615.

The entire vent diffuser 600 could be manufactured as a single, integral, unitary part using Additive Manufacturing Technology or one or more parts of vent diffuser 600 could be manufactured using Additive Manufacturing Technology and then assembled together.

In the example shown in FIG. 12, first, second, and third lattice structures 250, 650, 265 can be formed by triply periodic surfaces that are gyroid or gyroid-like. For example, first lattice structure 250 could be formed by gyroid or gyroid-like triply periodic surfaces that are periodic in cylindrical coordinates and second and third lattice structures 650, 265 could be formed by gyroid or gyroid-like triply periodic surfaces that are periodic in spherical coordinates, as discussed above.

Whether first, second, and third lattice structures 250, 650, 265 are formed using gyroid or gyroid-like triply periodic surfaces or other triply periodic surfaces, passages 255, 655, 270 formed through first, second, and third lattice structures 250, 650, 265 will have entirely arcuate surfaces. In addition, the triply periodic surfaces of first, second, and third lattice structures 250, 650, 265 are also preferably oriented so that there are no unimpeded radial flow paths in passages 255, 655, 270. The arcuate surfaces provide losses to reduce the pressure of the fluid flow through vent diffuser 600 and minimize the turbulence and separation that can occur using other vent types. Therefore, noise produced by fluid flowing through first, second, and third lattice structures 250, 650, 265 is minimized.

First, second, and third lattice structures 250, 650, 265 can have any volume fraction or ratio desired for a particular application and the volume fraction can be constant throughout the lattice or can vary radially and/or longitudinally along the lattice, for example, by stretching or compressing the triply periodic surfaces in the radial and/or longitudinal direction. In the particular example shown in FIG. 12, first and third lattice structures 250, 265 have a different volume fraction than second lattice structure 650. In addition, first, second, and third lattice structures 250, 650, 265 can also have any unit cell size desired for a particular application and the unit cell size can also be constant throughout the lattice or can vary radially and/or longitudinally along the lattice, for example, by varying the thickness of the walls forming the triply periodic surfaces in the radial and/or longitudinal directions. In the particular example shown in FIG. 12, first and third lattice structure 250, 265 have a different unit cell size than second lattice structure 650.

Figure 13:
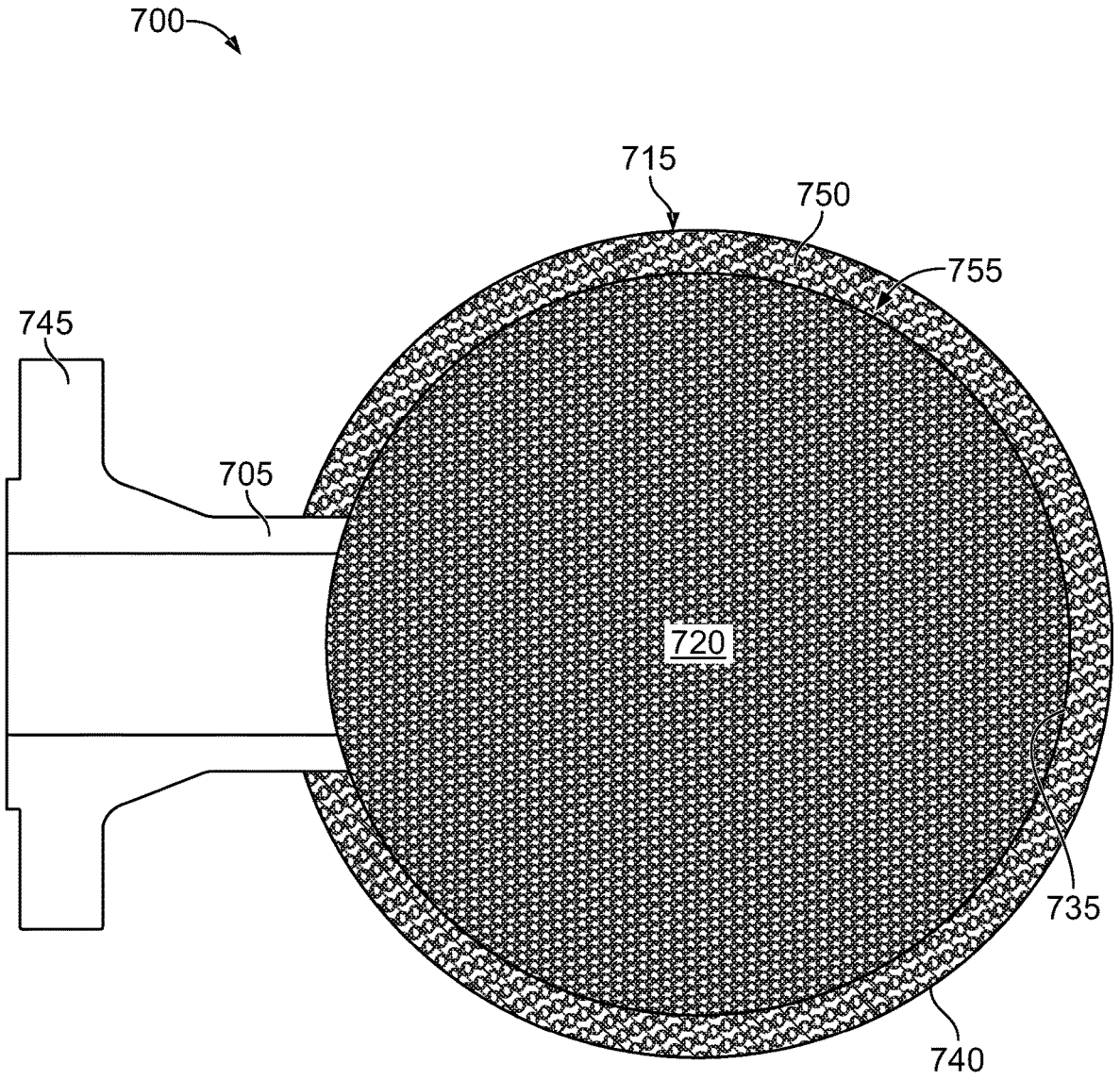
FIG. 13 is a cross-sectional view of a fifth example vent diffuser.

Referring to FIG. 13, a fifth example vent diffuser 700 is shown. Vent diffuser 700 has a wall 715, which in the example shown is spherical but could by any other shape desired, such as cylindrical, that extends from a solid wall 705 and forms a hollow central bore 720. A flange 745 extends from solid wall 705 to connect vent diffuser 700 to a pipe or other device to be vented. Wall 715 has a lattice structure 750 formed of a plurality of triply periodic surfaces that form a plurality of passages 755 extending between inner surface 735 and outer surface 740 of wall 715. Passages 755 can be used to characterized and/or condition fluid flowing through vent diffuser 700 by, for example, reducing the pressure of the fluid as it flows through passages 755.

If wall 715 were cylindrical, rather than spherical, an arcuate end wall can be located at a second end of wall 715, opposite a first end. Arcuate end wall could have a semi-spherical shape or other curved shape and a second lattice structure formed of a second plurality of triply periodic surfaces that form a plurality of passages extending between an inner surface and an outer surface of the end wall. Like passages 755, the passages in the end wall can be used to characterized and/or condition fluid flowing through vent diffuser 700 by, for example, reducing the pressure of the fluid as it flows through the passages. The arcuate end wall could be manufactured as a separate part and attached to the second end of the cylindrical wall, such as by welding or other suitable process, or the cylindrical wall and the end wall could be manufactured as one single, integral, unitary part using Additive Manufacturing Technology, as described above, or any other suitable process.

The entire vent diffuser 700 could be manufactured as a single, integral, unitary part using Additive Manufacturing Technology or one or more parts of vent diffuser 700 could be manufactured using Additive Manufacturing Technology and then assembled together.

In the example shown in FIG. 13, lattice structure 750 can be formed by triply periodic surfaces that are gyroid or gyroid-like. For example, lattice structure 750 could be formed by gyroid or gyroid-like triply periodic surfaces that are periodic in spherical coordinates, as discussed above. Alternatively, wall 715 were cylindrical, rather than spherical, the lattice structure of the cylindrical wall could be formed by gyroid or gyroid-like triply periodic surfaces that are periodic in cylindrical coordinates and the lattice structure of the end wall could be formed by gyroid or gyroid-like triply periodic surfaces that are periodic in spherical coordinates, as discussed above.

Whether lattice structure 750, or the lattice structures of a cylindrical wall or arcuate end wall, are formed using gyroid or gyroid-like triply periodic surfaces or other triply periodic surfaces, the passages formed through the lattice structures will have entirely arcuate surfaces. In addition, the triply periodic surfaces of the lattice structures are also preferably oriented so that there are no unimpeded radial flow paths in the passages. The arcuate surfaces provide losses to reduce the pressure of the fluid flow through vent diffuser 700 and minimize the turbulence and separation that can occur using other vent types. Therefore, noise produced by fluid flowing through the lattice structures is minimized.

Lattice structure 750, or the lattice structures of a cylindrical wall and/or arcuate end wall, can have any volume fraction or ratio desired for a particular application and the volume fraction can be constant throughout the lattice structure or can vary radially and/or longitudinally along the lattice, for example, by stretching or compressing the triply periodic surfaces in the radial and/or longitudinal direction. In addition, lattice structure 750, or the lattice structures of a cylindrical wall and/or arcuate end wall, can also have any unit cell size desired for a particular application and the unit cell size can also be constant throughout the lattice or can vary radially and/or longitudinally along the lattice, for example, by varying the thickness of the walls forming the triply periodic surfaces in the radial and/or longitudinal directions. In the particular example shown in FIG. 13, the unit call size of lattice structure 750 of wall 715 changes from inner surface 735 to outer surface 740. Alternatively, if wall 715 were cylindrical and vent diffuser 700 had an arcuate end wall, the unit cell size of the lattice structures of the cylindrical wall and the end wall could change from the inner surfaces to the outer surfaces of the cylindrical wall and the end wall.

While various embodiments have been described above, this disclosure is not intended to be limited thereto. Variations can be made to the disclosed embodiments that are still within the scope of the appended claims.

What is claimed is:

1. A diffuser, comprising:

a cylindrical wall having a first lattice structure formed of a first plurality of triply periodic surfaces that are periodic in cylindrical coordinates, the cylindrical wall having a first end and a second end, opposite the first end, and the first lattice structure having a plurality of passages that extend between an inner surface of the cylindrical wall and an outer surface of the cylindrical wall; and an arcuate end wall located at the second end of the cylindrical wall and having a second lattice structure formed of a second plurality of triply periodic surfaces that are periodic in spherical coordinates, the second lattice structure having a plurality of passages that extend between an inner surface of the arcuate end wall and an outer surface of the arcuate end wall.

2. The diffuser of claim 1, wherein the first plurality of triply periodic surfaces and the second plurality of triply periodic surfaces are gyroid.

3. The diffuser of claim 1, wherein the first plurality of triply periodic surfaces are oriented such that there are no unimpeded linear radial flow paths in the plurality of passages through the cylindrical wall and the second plurality of triply periodic surfaces are oriented such that there are no unimpeded linear radial flow paths in the plurality of passages through the arcuate end wall.

4. The diffuser of claim 1, wherein the diffuser is an inline diffuser and comprises a first flange adjacent the first end of the cylindrical wall, an outlet head adjacent the outer surface of the cylindrical wall and secured to the cylindrical wall, and a second flange attached to the outlet head.

5. A diffuser, comprising:

a first wall having a first lattice structure formed of a first plurality of triply periodic surfaces, the first lattice structure having a plurality of passages that extend between an inner surface of the first wall and an outer surface of the first wall;

a second wall having a second lattice structure formed of a second plurality of triply periodic surfaces, the second lattice structure having a plurality of passages that extend between an inner surface of the second wall and an outer surface of the second wall; and an annular cavity separating the first wall and the second wall.

6. The diffuser of claim 5, wherein the first lattice structure has a different volume fraction than the second lattice structure.

7. The diffuser of claim 5, wherein the first lattice structure has a different unit cell size than the second lattice structure.

8. The diffuser of claim 5, wherein:

the first wall is cylindrical and the first plurality of triply periodic surfaces are periodic in cylindrical coordinates; and the second wall is cylindrical and the second plurality of triply periodic surfaces are periodic in cylindrical coordinates.

9. The diffuser of claim 8, comprising:

a first arcuate end wall located at a second end of the first wall and having a third lattice structure formed of a third plurality of triply periodic surfaces that are periodic in spherical coordinates, the third lattice structure having a plurality of passages that extend between an inner surface of the first arcuate end wall and an outer surface of the first arcuate end wall; and a second arcuate end wall located at a second end of the second wall and having a fourth lattice structure formed of a fourth plurality of triply periodic surfaces that are periodic in spherical coordinates, the fourth lattice structure having a plurality of passages that extend between an inner surface of the second arcuate end wall and an outer surface of the second arcuate end wall.

10. The diffuser of claim 5, wherein:

the first wall is arcuate and the first plurality of triply periodic surfaces are periodic in spherical coordinates; and the second wall is arcuate and the second plurality of triply periodic surfaces are periodic in spherical coordinates.

11. The diffuser of claim 5, wherein:

the first wall is cylindrical and the first plurality of triply periodic surfaces are periodic in cylindrical coordinates; and the second wall is spherical and the second plurality of triply periodic surfaces are periodic in spherical coordinates.

12. The diffuser of claim 5, wherein the first plurality of triply periodic surfaces and the second plurality of triply periodic surfaces are gyroid.

13. The diffuser of claim 5, wherein the first plurality of triply periodic surfaces are oriented such that there are no unimpeded linear radial flow paths in the plurality of passages through the first wall and the second plurality of triply periodic surfaces are oriented such that there are no unimpeded linear radial flow paths in the plurality of passages through the second wall.

14. A diffuser, comprising:

a wall having a lattice structure formed of a plurality of triply periodic surfaces, the lattice structure having a plurality of passages that extend between an inner surface of the wall and an outer surface of the wall; wherein the lattice structure has a varying unit cell size.

15. The diffuser of claim 14, wherein the wall is cylindrical and the triply periodic surfaces are periodic in cylindrical coordinates.

16. The diffuser of claim 15, wherein the unit cell size of the lattice structure changes from the inner surface of the wall to the outer surface.

17. The diffuser of claim 15, wherein the wall is cylindrical and the unit cell size of the lattice structure changes from a first end of the wall to a second end of the wall.

18. The diffuser of claim 15, comprising:

an arcuate end wall located at a second end of the wall and having a second lattice structure formed of a second plurality of triply periodic surfaces that are periodic in spherical coordinates, the second lattice structure having a plurality of passages that extend between an inner surface of the arcuate end wall and an outer surface of the arcuate end wall; wherein a unit cell size of the second lattice structure changes from the inner surface of the arcuate end wall to the outer surface of the arcuate end wall.

19. The diffuser of claim 14, wherein the wall is spherical and the triply periodic surfaces are periodic in spherical coordinates.

20. The diffuser of claim 19, wherein the unit cell size of the lattice structure changes from the inner surface of the wall to the outer surface.

* * * * *